US007407140B2

(12) United States Patent
Sen

(10) Patent No.: US 7,407,140 B2
(45) Date of Patent: Aug. 5, 2008

(54) ADJUSTING DEVICE FOR POSITIONING SHOWER HEAD

(76) Inventor: Chen Te Sen, 1F, No. 8, Alley 99, Lane 300, Sec. 1, Jang-nan Rd., Chang Hua City, Chang Hua Hsien (TW)

( * ) Notice: Subject to any disclaimer, the term of this patent is extended or adjusted under 35 U.S.C. 154(b) by 39 days.

(21) Appl. No.: 11/624,226

(22) Filed: Jan. 18, 2007

(65) Prior Publication Data

US 2008/0121771 A1 May 29, 2008

(30) Foreign Application Priority Data

Nov. 27, 2006 (TW) ..... 95220893 U

(51) Int. Cl.
*F16L 3/00* (2006.01)
*A47K 3/00* (2006.01)
*B05B 15/06* (2006.01)

(52) U.S. Cl. ..... 248/121; 248/229.1; 248/229.14; 248/316.1; 4/615; 239/283

(58) Field of Classification Search ..... 248/121, 248/229.1, 229.11, 229.14, 229.16, 227.4, 248/230.2, 230.5, 230.7, 125.7, 316.1, 75; 4/570, 605, 615; 239/283, 280, 273, 280.5
See application file for complete search history.

(56) References Cited

U.S. PATENT DOCUMENTS

| | | | | | |
|---|---|---|---|---|---|
| 661,677 | A * | 11/1900 | Taylor | 211/22 |
| 2,873,999 | A * | 2/1959 | Webb | 239/588 |
| 4,211,380 | A * | 7/1980 | Lillegard et al. | 248/229.15 |
| 4,964,573 | A * | 10/1990 | Lipski | 239/283 |
| 5,632,049 | A * | 5/1997 | Chen | 4/570 |
| 6,024,331 | A * | 2/2000 | Bischoff et al. | 248/229.1 |
| 6,473,916 | B2 * | 11/2002 | Schi.o slashed.dt | 4/567 |
| 6,502,796 | B1 * | 1/2003 | Wales | 248/316.1 |
| 7,197,776 | B2 * | 4/2007 | Tsai | 4/615 |

* cited by examiner

*Primary Examiner*—Anita M King
(74) *Attorney, Agent, or Firm*—Ming Chow Sinorica, LLC

(57) ABSTRACT

An adjusting device for positioning shower head includes a holder movably connected to a rod and a clip for positioning a shower head is rotatably connected to the holder. A frame is connected to the holder and a clamp is movably located between the holder and the frame. The clamp has a clamp shoe which is in a first position to contact the rod or in a second position to be removed from the rod. The clamp has an insertion extending therefrom which extends through the frame and is connected with a lever unit. A spring is mounted on the insertion. The lever unit can pull the insertion to remove the clamp shoe away from the rod to allow the holder to be moved along the rod.

6 Claims, 10 Drawing Sheets

ADJUSTING DEVICE FOR POSITIONING SHOWER HEAD

FIELD OF THE INVENTION

The present invention relates to an adjusting device for positioning shower head on a rod so as to meet users of different heights.

BACKGROUND OF THE INVENTION

A conventional way for positioning a shower head along a rod 70 fixed on wall in a bath room is shown in FIG. 10 and generally includes an adjusting member 80 which is movably connected to the rod 70. The adjusting member 80 has a locking knob 81 at a first end of the adjusting member 80 and a hooking end 82 at a second end of the adjusting member 80. By rotating the locking knob 81 in a first direction, the adjusting member 80 can be freely moved along the rod 70 so as to position the adjusting member 80 at a desired height. By rotating the locking knob 81 in a second direction, the adjusting member 80 is locked to the rod 70. The shower head can be hooked on the hooking end 82 for convenience of use by the users. However, the tubular locking knob 81 might not be easily operated when the user's hand is slippery or if the user is a handicapped person.

The present invention intends to provide an adjusting device for positioning shower head, wherein the device includes a lever which is easily operated simply by pushing it, and the device is locked on the rod again simply by pushing the lever again.

SUMMARY OF THE INVENTION

The present invention relates to an adjusting device for positioning shower head, and the device comprises a holder and a clip is rotatably connected to holder so as to hold a shower head thereon. A frame is connected to the holder and a clamp is located between the holder and the frame. The clamp has a clamp shoe connected to a first end of the clamp and an insertion extends from a second end of the clamp. The insertion extends through a first central hole defined through the frame and a spring is mounted on the insertion. A lever unit is connected to a distal end of the insertion that extends through the frame such that the clamp together with the clamp shoe is movable by operation of the lever unit.

The primary object of the present invention is to provide a height adjusting device for shower head and includes a lever unit which is easily to operate to move the holder along a rod so that the users of different heights can easily adjust the position of the shower head.

Another object of the present invention is to provide a height adjusting device for shower head wherein the lever unit can be simply pushed to lock or unlock the holder and even handicapped people can operate it.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 7:
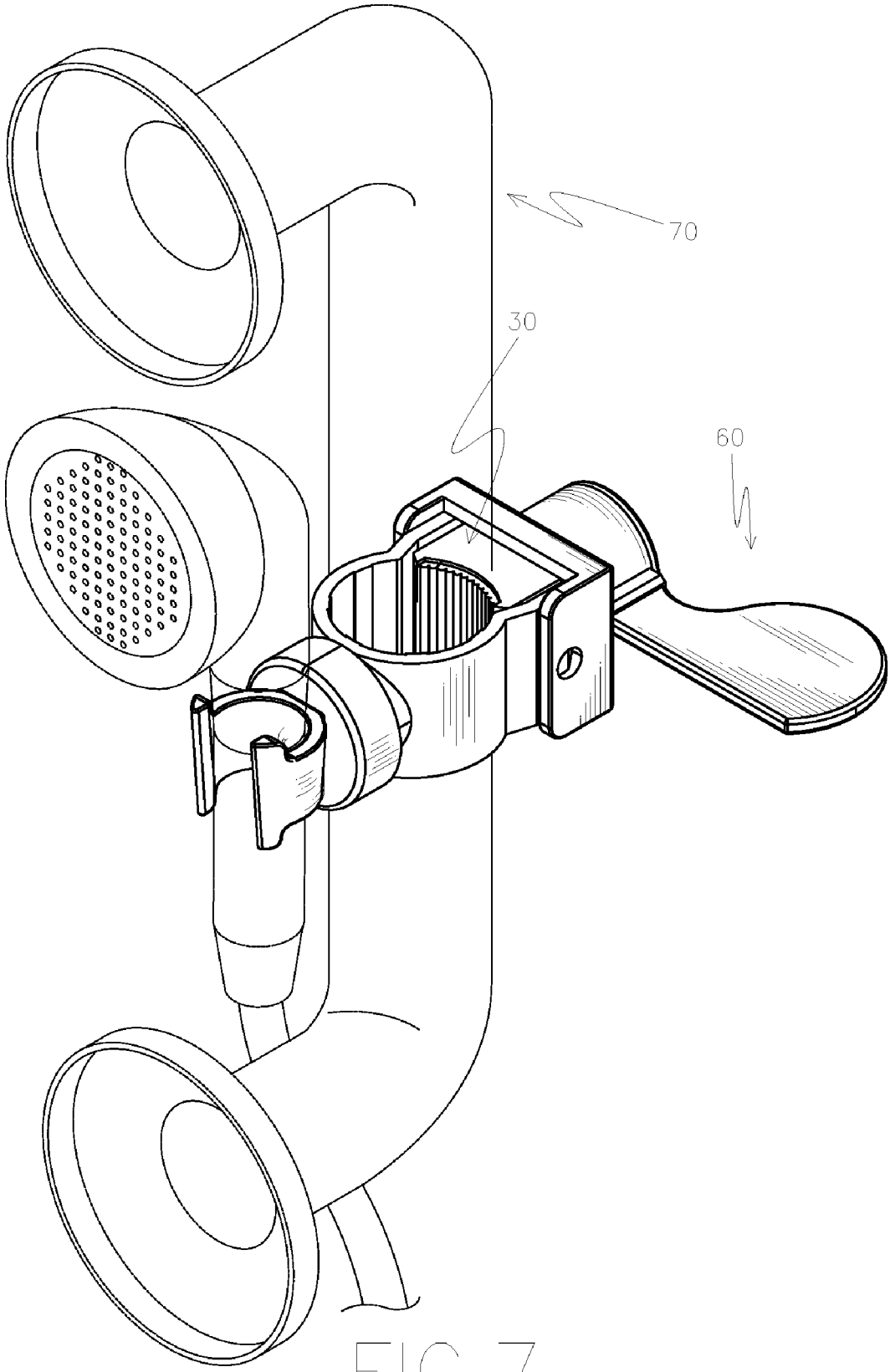
FIG. 7 shows that the adjusting device of the present invention is connected to the rod.

Referring to FIGS. 1 to 4, the adjusting device for positioning shower head of the present invention comprises a C-shaped holder 10 having a stepped protrusion 11 extending from a first end thereof and an open second end, the holder 10 movably holds on a rod 70 as shown in FIG. 7. The stepped protrusion 11 is a tubular protrusion with an open end and a connection tube 12 extends from a center of the stepped protrusion 11. A tubular portion is formed with the stepped protrusion 11 and includes a recess 13 therein. A positioning unit 130 is inserted in the recess 13 and includes a biasing member a bead which is biased by the biasing member. A clip 20 is rotatably mounted onto the stepped protrusion 11 and has two clipping jaws for positioning a shower head as shown in FIG. 7.

Figure 1:
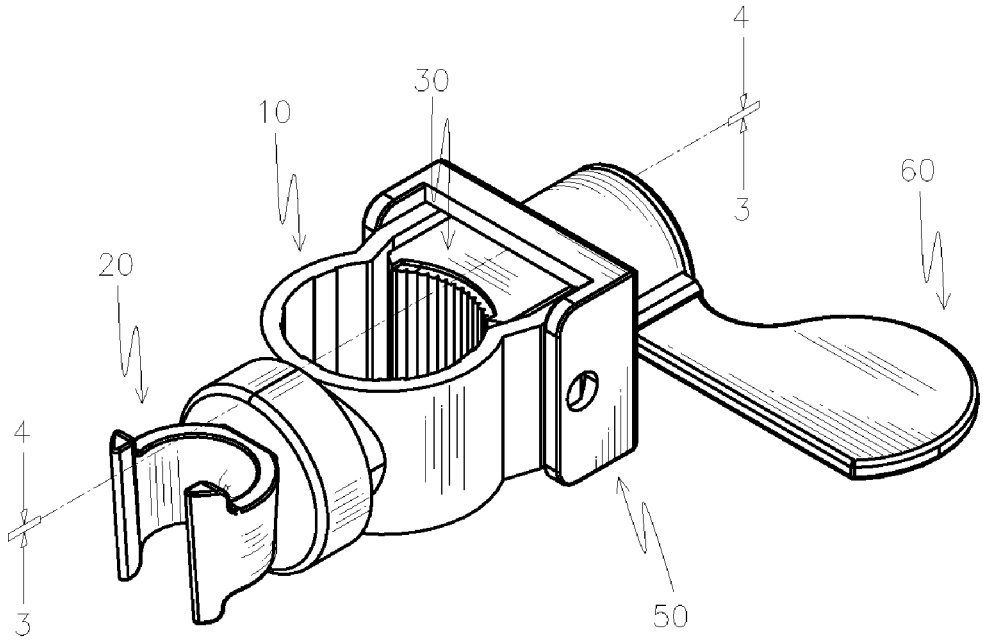
FIG. 1 is a perspective view to show the adjusting device of the present invention.
Figure 2:
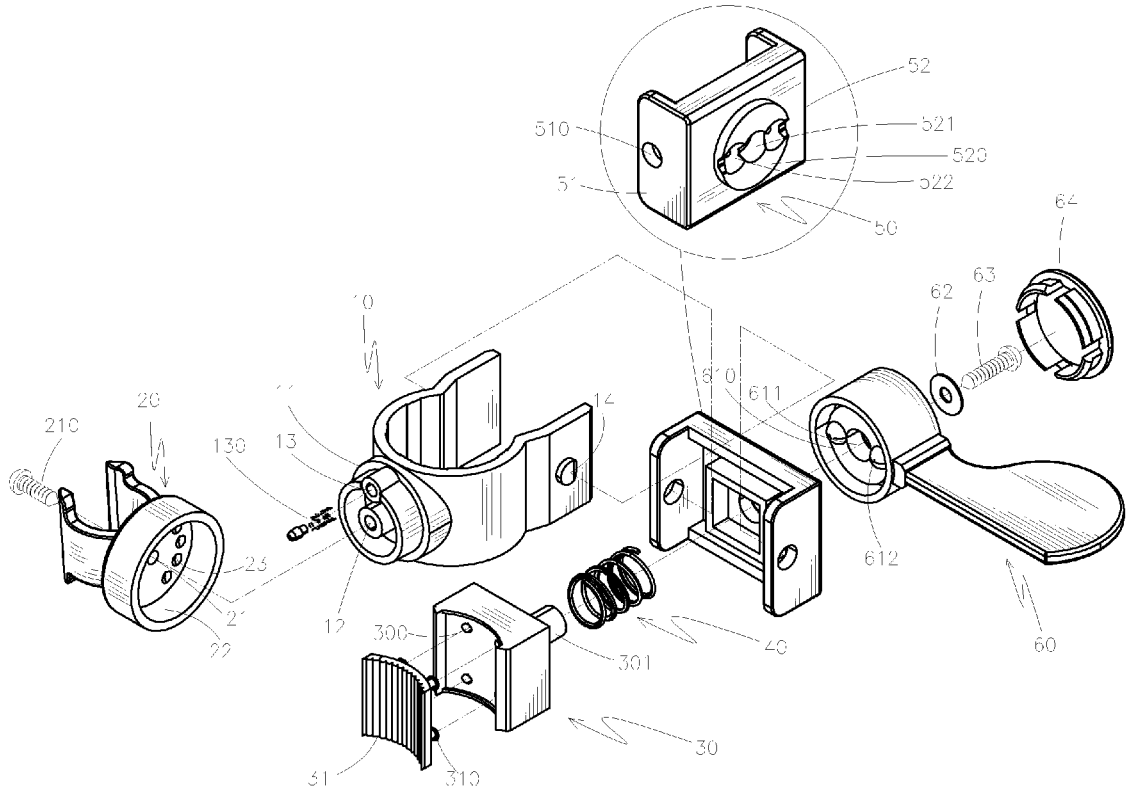
FIG. 2 is an exploded view to show the adjusting device of the present invention.
Figure 3:
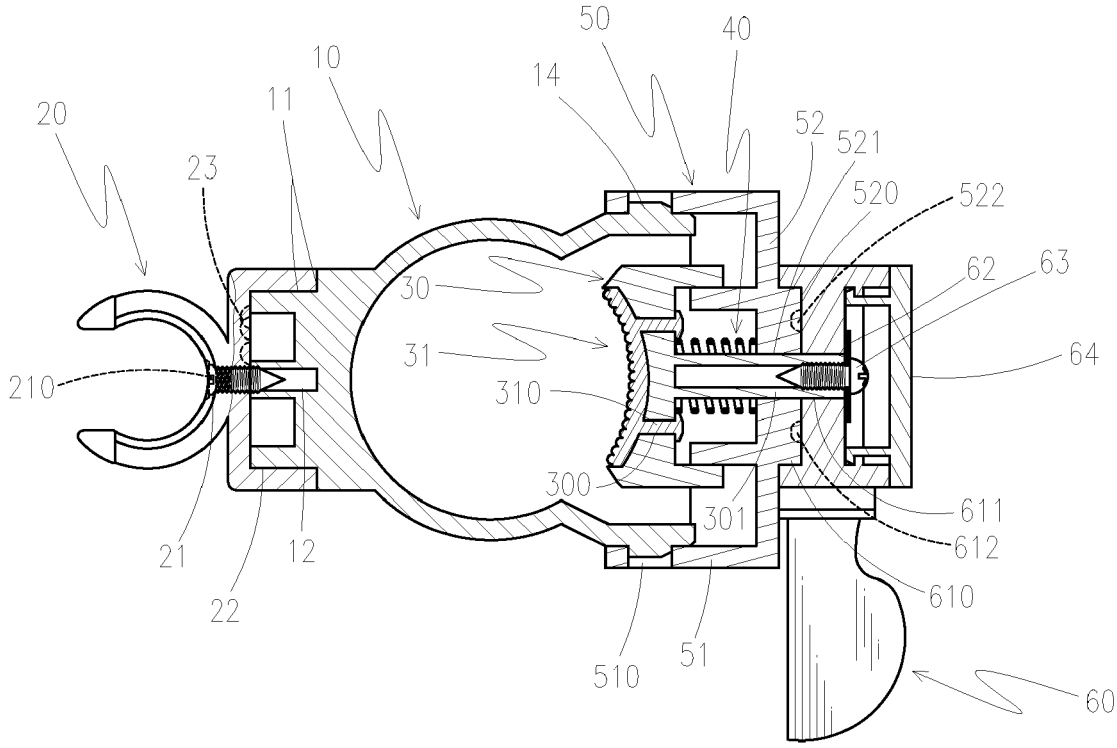
FIG. 3 is a cross sectional view along line 3-3 in FIG. 1.
Figure 4:
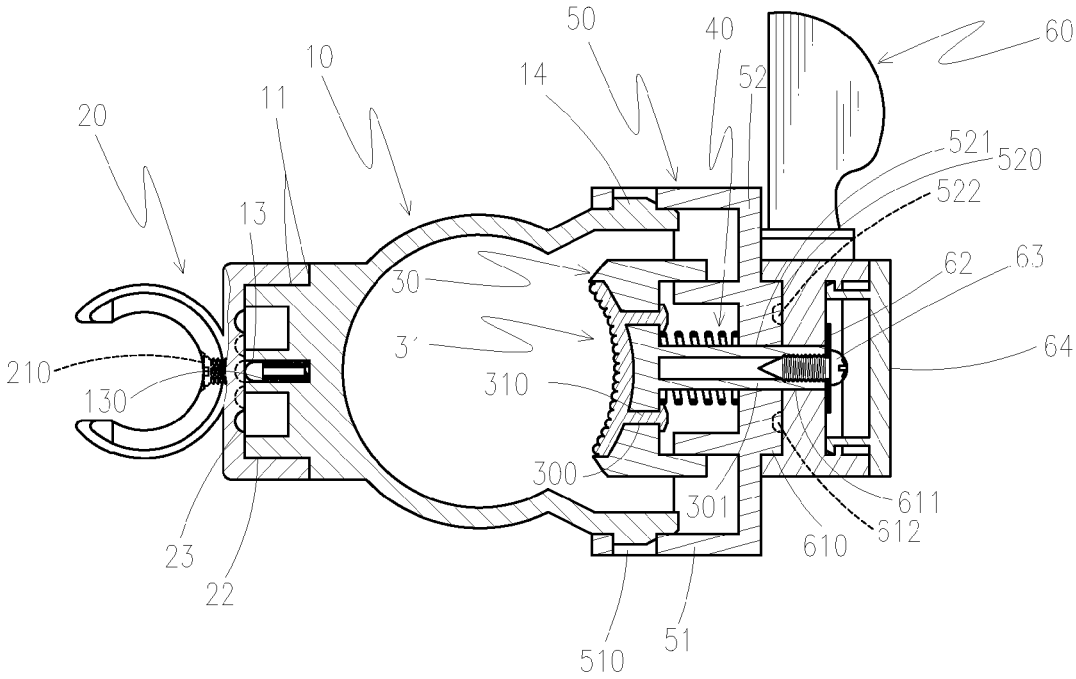
FIG. 4 is a cross sectional view along line 4-4 in FIG. 1.
Figure 6:
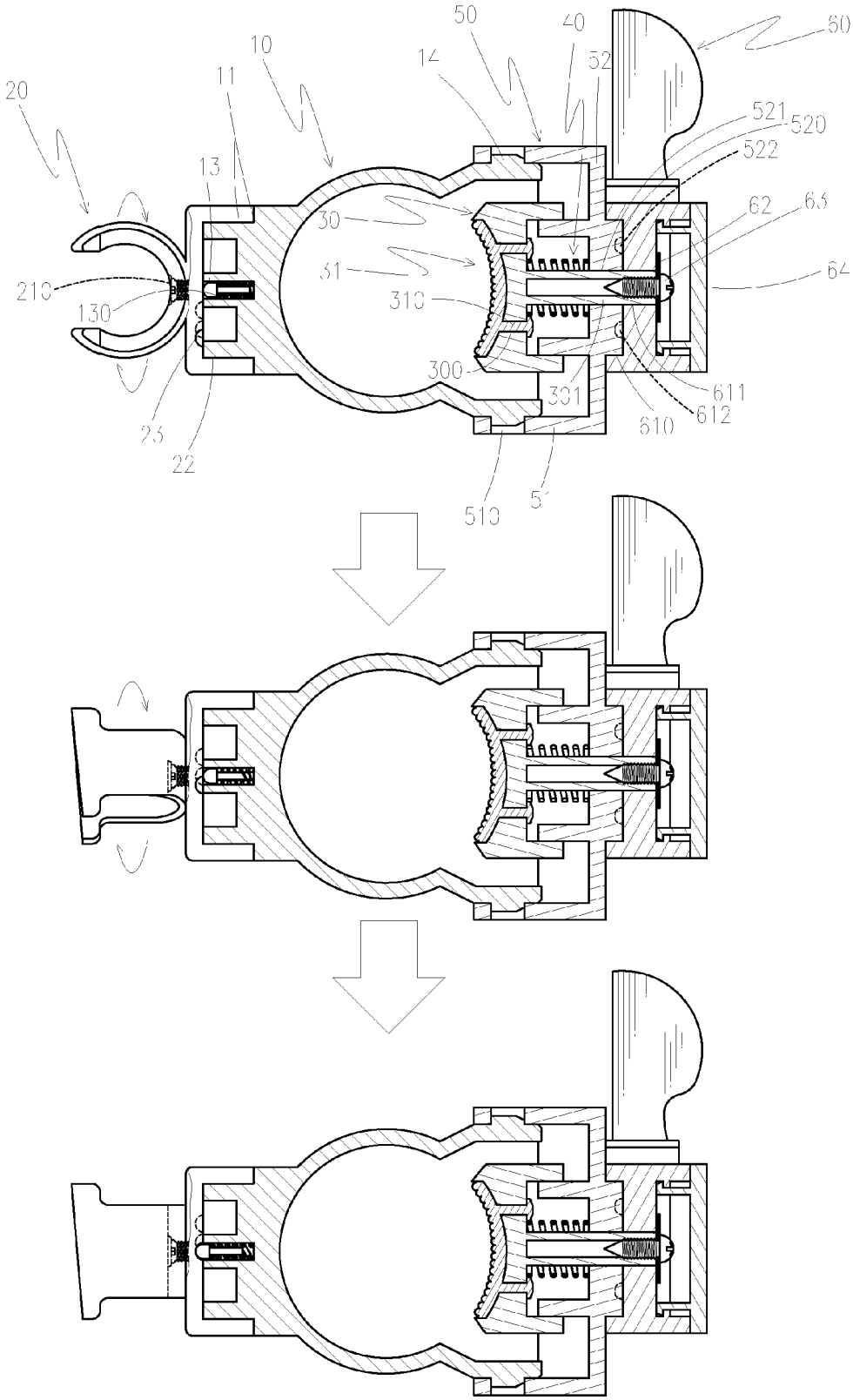
FIG. 6 shows consecutive actions when rotating the clip relative to the holder.

The clip 20 includes a circular skirt in which a first recessed portion 22 is defined and the stepped protrusion 11 is received in the first recessed portion 22. A first connection piece 210 extends through a central hole 21 in the clip 20 and is connected to the connection tube 12 so as to connect the clip 20 and the stepped protrusion 11. The clip 20 includes a plurality of detents 23 defined in an inner surface of the first recessed portion 22 so that the bead can be engaged with one of the detents 23 when rotating the clip 20 to different angular positions as shown in FIGS. 4 and 6.

A frame 50 is connected to the second end of the holder 10 and includes a bottom 52 and two sidewalls 51 extending from the bottom 52. Each sidewall 51 has a through hole 510. Two bosses 14 extend from two sides of the open end of the holder 10 and the two sides of the holder 10 are located at two respective insides of the sidewalls 51 of the frame 50 and the two bosses 14 are inserted into the two through holes 510.

A clamp 30 is located between the holder 10 and the frame 50. The clamp 30 has a clamp shoe 31 connected to a first end of the clamp 30 and an insertion 301 extends from a second end of the clamp 30. The insertion 301 extends through a first central hole 521 defined through the frame 50 and a spring 40 is mounted on the insertion 301. The clamp shoe 31 has a rough surface defined in a first side thereof so as to be in contact with the rod 70 and a plurality of positioning tubes 310 extend from a second side of the clamp shoe 31. The positioning tubes 310 are securely inserted into positioning holes 300 defined in the clamp 30 so as to connect the clamp shoe 31 to the clamp 30. A circular protrusion 520 extends from the frame 50 and the first central hole 521 is defined through the circular protrusion 520. Two concavities 522 are defined in an outer surface of the circular protrusion 520.

A lever unit 60 includes a second recessed portion 610 and a second central hole 611 is defined through the lever unit 60. The circular protrusion 520 of the frame 50 is received in the second recessed portion 610. A second connection piece 63 extends through a washer 62, the second central hole 611, the first central hole 521 and is connected to the insertion 301 of the clamp 30. A cover 64 is the mounted onto the lever unit 60. Two positioning projections 612 extend from an inner surface of the second recessed portion 610 and are removably engaged with the concavities 522 of the frame 50.

Figure 5:
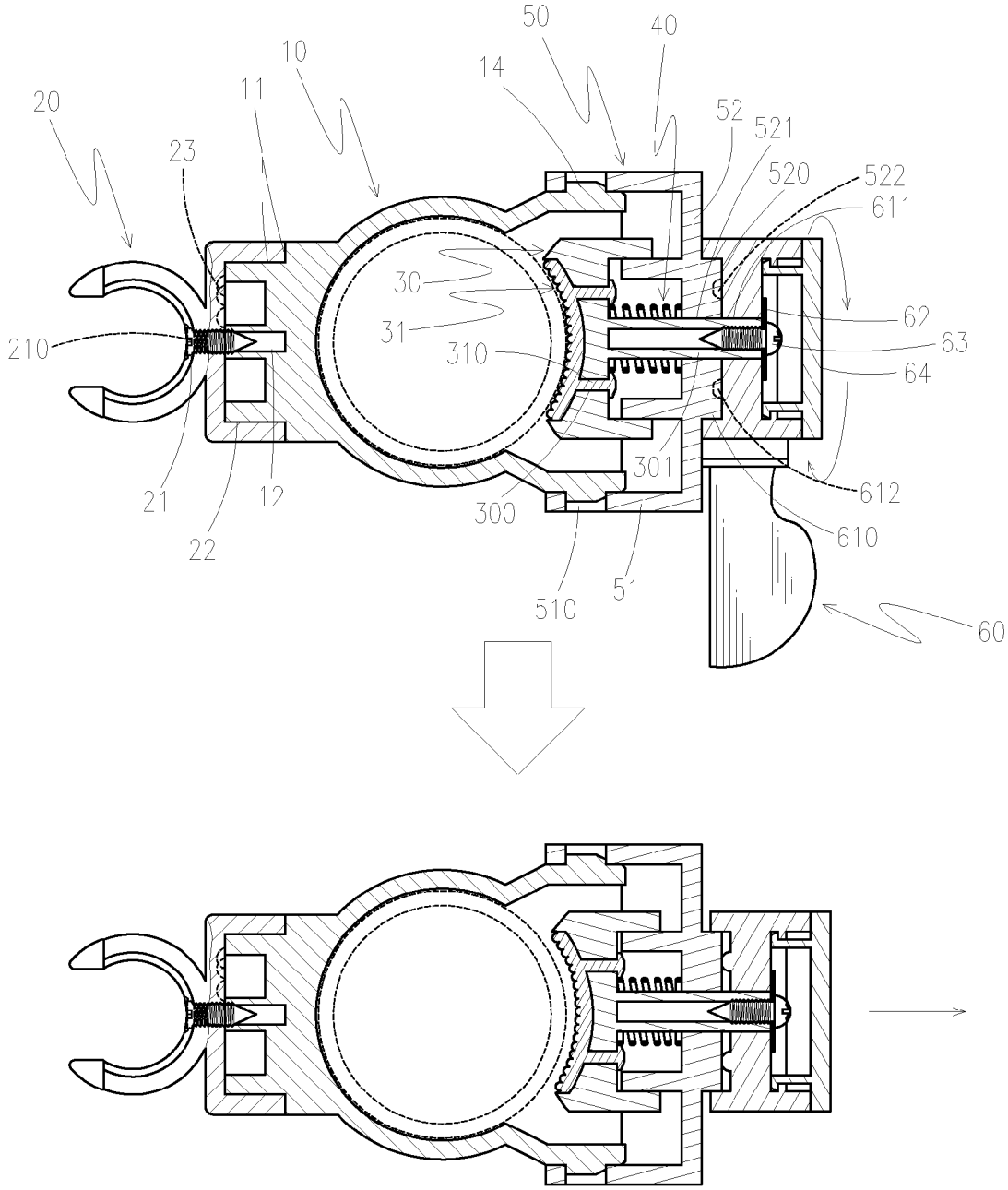
FIG. 5 shows two positions wherein the clamp shoe is in contact with the rod and removed from the rod.
Figure 8:
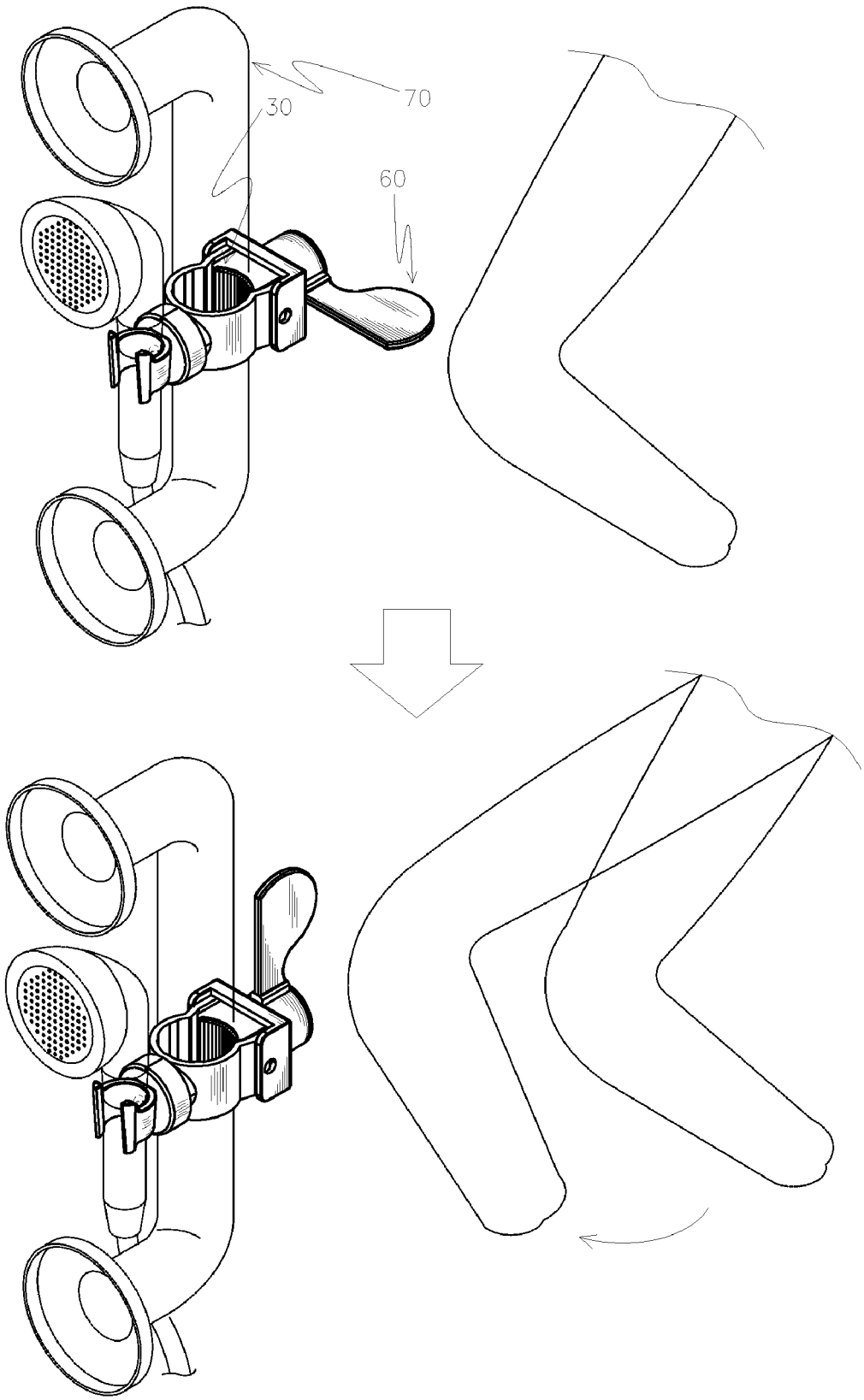
FIG. 8 shows the lever unit is operated by a finger.

As shown in FIG. 5, when adjusting the holder 10, the user pushes the lever of the lever unit 60 as shown in FIG. 8 and the lever unit 60 is rotated and the positioning projections 612 are removed from the concavities 522. The positioning projections 612 are in contact with the surface of the circular protrusion 520 thereby pulling the clamp 30 away from the rod 70. In other words, the clamp shoe 31 is separated from the rod 70 so that the user can move the holder 10 along the rod 70. When the holder 10 is moved to a desired position, the lever unit 60 is rotated back to let the positioning projections 612 be engaged with the concavities 522 again, and the clamp 30 is moved toward the rod 70 by the spring 40, and the clamp shoe 31 is in contact the rod 70 again.

The adjustment is easy and can be done by simply operating the lever of the lever unit 60 so that any user can do the adjustment without difficulties.

Figure 9:
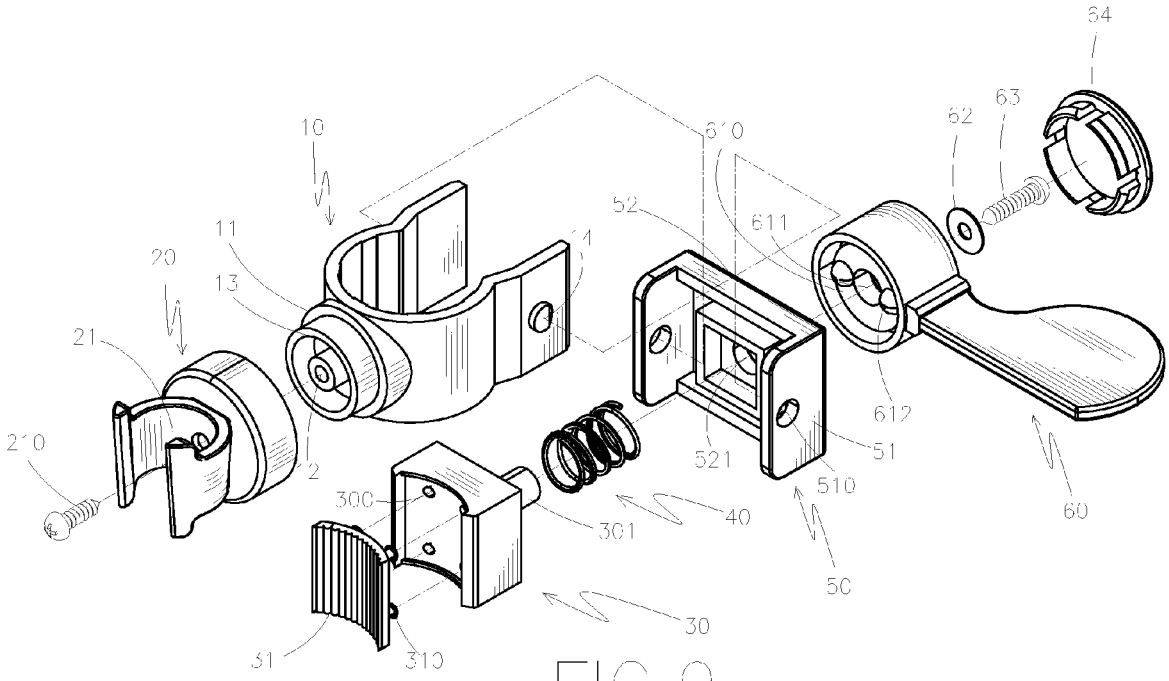
FIG. 9 shows another embodiment wherein the clip is securely fixed to the holder.
Figure 10:
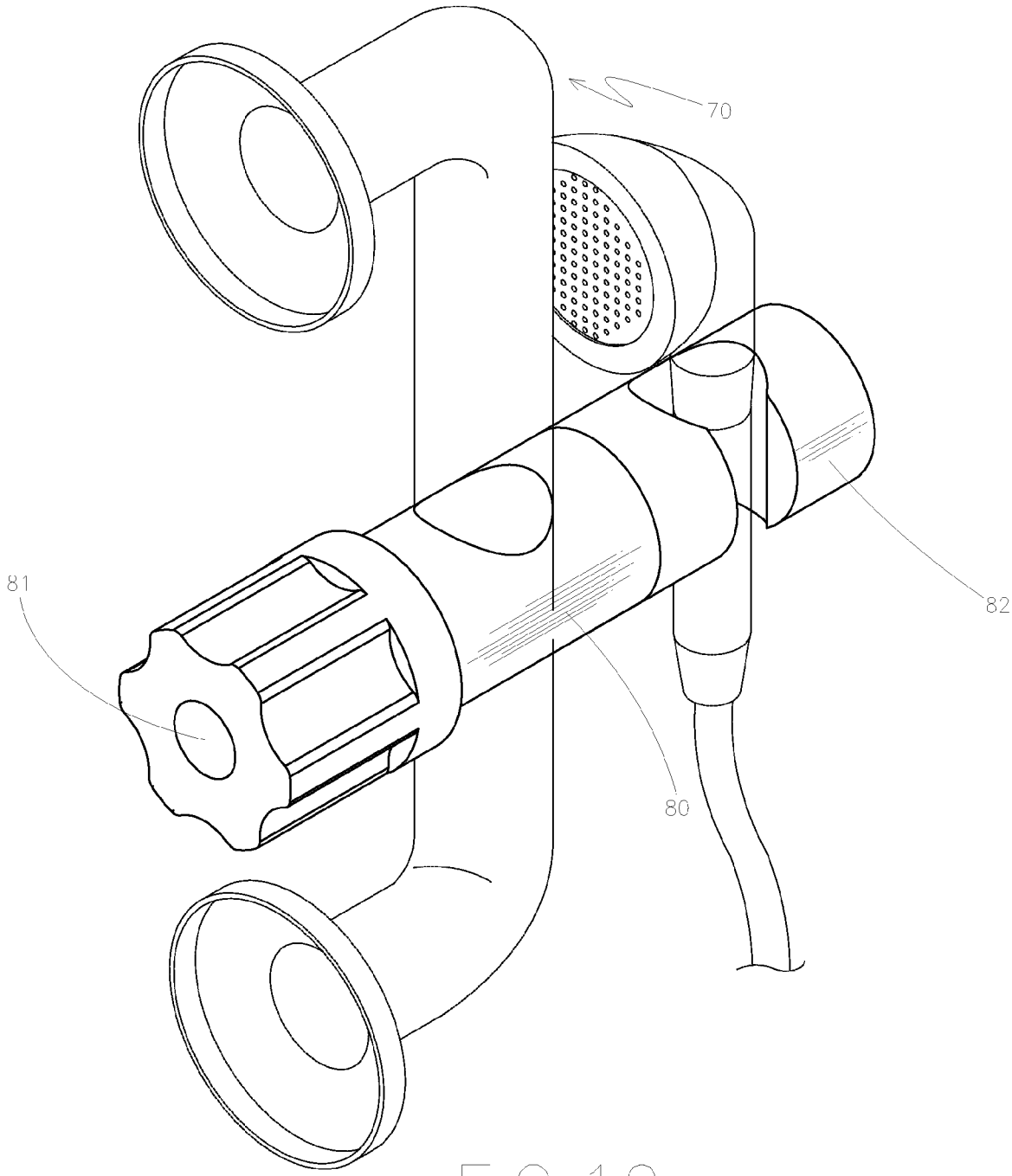
FIG.10 PRIOR ART
FIG. 10 shows a conventional adjusting device for positioning the shower head.

As shown in FIG. 9, the adjusting device can also include a fixed clip 20 which is fixedly connected to the stepped protrusion 11 and no positioning unit 130 and recess 13 needed.

While we have shown and described the embodiment in accordance with the present invention, it should be clear to those skilled in the art that further embodiments may be made without departing from the scope of the present invention.

What is claimed is:

1. An adjusting device for positioning shower head, comprising:

a holder adapted to be movably mounted on a rod;

a clip rotatably connected to a first end of the holder and having two clipping jaws;

a frame connected to a second end of the holder and a clamp located between the holder and the frame, the clamp having a clamp shoe connected to a first end of the clamp and an insertion extending from a second end of the clamp, the insertion extending through a first central hole defined through the frame and a spring mounted on the insertion, and a lever unit connected to a distal end of the insertion that extends through the frame such that the clamp together with the clamp shoe are movable by operating the lever unit.

2. The device as claimed in claim 1, wherein the clip includes a circular skirt in which a first recessed portion is defined and a stepped protrusion extends from the first end of the holder, the stepped protrusion is received in the first recessed portion, a connection tube extends from a center of the stepped protrusion, a first connection piece extending through a central hole in the clip and connected to the connection tube so as to connect the clip and the stepped protrusion.

3. The device as claimed in claim 2, wherein the stepped protrusion includes a recess defined therein and a positioning unit is inserted in the recess, the positioning unit includes a biasing member a bead which is biased by the biasing member, the clip includes a plurality of detents defined in an inner surface of the first recessed portion, the bead is engaged with one of the detents.

4. The device as claimed in claim 1, wherein the frame includes a bottom and two sidewalls extending from the bottom, each sidewall has a through hole, two bosses extend from two sides of an open end of the holder and the two sides of the holder are located at two respective insides of the sidewalls of the frame and the two bosses are inserted into the two through holes.

5. The device as claimed in claim 1, wherein the clamp shoe has a rough surface defined in a first side thereof and positioning tubes extend from a second side of the clamp shoe, the positioning tubes are securely inserted into positioning holes defined in the clamp.

6. The device as claimed in claim 1, wherein a circular protrusion extends from the frame and the first central hole is defined through the circular protrusion, two concavities are defined in an outer surface of the circular protrusion, the lever unit includes a second recessed portion and a second central hole is defined through the lever unit, the circular protrusion of the frame is received in the second recessed portion, a second connection piece extends through the second central hole, the first central hole and is connected to the insertion of the clamp, two positioning projections extend from an inner surface of the second recessed portion and are removably engaged with the concavities of the frame.

* * * * *